United States Patent [19]

Lerner

[11] 4,054,913

[45] Oct. 18, 1977

[54] HYBRID IMPLOSION PROTECTION SYSTEM FOR A FLANGELESS FACEPLATE COLOR CATHODE RAY TUBE AND METHOD OF ASSEMBLY THEREOF

[75] Inventor: Martin L. Lerner, River Forest, Ill.

[73] Assignee: Zenith Radio Corporation, Glenview, Ill.

[21] Appl. No.: 719,645

[22] Filed: Sept. 1, 1976

[51] Int. Cl.[2] ..... H01J 29/87

[52] U.S. Cl. ..... 358/246; 358/247; 220/2.1 A; 220/2.3 A

[58] Field of Search ..... 358/246, 245, 247; 220/2.1 A, 2.3 A; 313/402

[56] References Cited

U.S. PATENT DOCUMENTS

| | | | |
|---|---|---|---|
| 2,222,197 | 11/1940 | Engels | 220/2.3 A |
| 3,512,234 | 5/1970 | Bongenaar et al. | 358/246 |
| 3,730,990 | 5/1973 | Miyata | 358/246 |
| 4,004,092 | 1/1977 | Rogers | 358/246 |
| 4,016,364 | 4/1977 | Rogers | 358/245 |
| 4,021,850 | 5/1977 | Rogers | 358/246 |

*Primary Examiner*—Robert L. Griffin
*Assistant Examiner*—Edward L. Coles
*Attorney, Agent, or Firm*—John H. Coult

[57] ABSTRACT

This disclosure depicts a color television picture tube having a glass bulb which includes an approximately rectangular, flangeless, three-dimensionally curved faceplate having a convex front surface, a concave rear surface and an edge surface. The bulb has a funnel with a convex seal land which mates with the concave inner surface of the faceplate. The tube has a hybrid implosion protection system comprising a high tensile strength frame which surrounds and closely hugs at least the edge surface of the faceplate to define a cavity between the frame and the edge surface. The cavity contains a hardened cement, the frame and cement binding up the edge surface of the faceplate to provide a measure of implosion protection. A tension member is disposed over the frame and the hardened cement in the cavity so as to surround the faceplate in straight lines between the faceplate corners. Means are provided on the frame for retaining the tension member on the faceplate corners. The member is under tension to produce radially inwardly directed force components acting on the faceplate corners through the frame and the hardened cement, the combination of the cemented frame and tension member producing a high degree of implosion protection for the bulb. A method for assembling the implosion protection system is also disclosed.

4 Claims, 4 Drawing Figures

HYBRID IMPLOSION PROTECTION SYSTEM FOR A FLANGELESS FACEPLATE COLOR CATHODE RAY TUBE AND METHOD OF ASSEMBLY THEREOF

CROSS REFERENCE TO RELATED APPLICATIONS

This application relates to but is not dependent upon, copending applications of common ownership herewith, including Ser. No. 623,854, filed Oct. 20, 1975 now U.S. Pat. No. 4,021,850; Ser. No. 623,852, filed Oct. 20, 1975 now U.S. Pat. No. 4,004,092; Ser. No. 639,741, filed Dec. 11, 1975 now U.S. Pat. No. 4,037,255; Ser. No. 623,853, filed Oct. 20, 1975 now U.S. Patent No. 4,016,364; Ser. No. 632,559, filed Nov. 17, 1975 now U.S. Pat. No. 4,012,773; Ser. No. 718,631, filed 8-30-76.

BACKGROUND OF THE INVENTION

This invention relates to a system for implosion protecting color television picture tubes and a method of assembly thereof. Conventionally, a color television picture tube has an evacuated glass bulb which includes a faceplate with a rearward flange and a funnel sealed to the faceplate flange along a planar sealing interface. The faceplate has a concave inner surface upon which is deposited a luminescent phosphor screen. Due to the high vacuum in the bulb, several tons of atmospheric pressure are exerted on the faceplate, causing the bulb to be susceptible to implosion. (The term "implosion"is defined by Underwriters Laboratory Incorporated as a "rapid and sudden inward bursting of a high-vacuum glass envelope.") It is of the utmost importance in the interest of safety to prevent the bulb from violently imploding should it be struck, for example, by a heavy missile.

There have evolved a number of approaches to implosion protecting color CRT's (cathode ray tubes) of the described type having a conventional bulb (with a flanged faceplate). One approach is implemented in systems referred to as "rimbond"systems. The rimbond system has a scalloped metal frame which surrounds the flange found on every conventional faceplate. A small gap between the frame and the faceplate flange is filled with a cement—typically an epoxy resin. In a rimbond system, the frame is not under tension. The cement contains the glass shards of a shattered faceplate long enough to permit gradual (and therefore nonviolent) devacuation of the bulb. Exemplary U.S. Pat. Nos. illustrating rimbond systems are 3,485,407; 3,558,818; 3,412,203 and 3,835,250. A major drawback to rimbond systems has been the large amount of (very costly) epoxy cement required.

A second basic implosion protection approach is termed the "tension band"approach. Systems implementing this approach comprise a band which is placed around the face plate flange and put under very high tension. The tension band around the faceplate flange constricts the flange and, like the rimbond systems, holds the shards of a fractured faceplate in position until the bulb has gradually devacuated. Numerous patents have been issued on various aspects of tension band systems. See U.S. Pat. Nos. 3,818,557; 3,456,076; 3,556,306; 3,597,537; 3777,057; 3,845,530; and 3,890,464.

Another approach is to bond a transparent protective shield over the front surface of the faceplate. Systems following this approach are commonly termed "bonded panel" systems.

Yet another approach to implosion-protecting color CRT's with conventional faceplates involves using an expansible frame and a tension band to constrain the expansibility of the frame. The frame comprises an overlapped pair of "C"-shaped half frames. A viscous cement is typically applied to each of the half-frames; the half-frames are then placed around the faceplate flange with their ends overlapping. Before the cement has set, a tension band is drawn up tightly around the frame and faceplate flange. It is common to use a lighter weight tension band than is used in a pure tension band system.

A U.S. Pat. No. 3,647,960 — Takemoto et al discloses still another implosion protection system for a color CRT of the type having a conventional bulb with a flanged faceplate. The implosion system of Takemoto et al comprises a series of closely spaced, mutually insulated turns of wire wrapped (with or without tension) around and adhered to the flange of the faceplate.

A U.S. patent to Powell et al — 3,519,161 discloses the use of a limited number of turns of reinforcing wire around the flange of a color CRT faceplate of the conventional type to enhance the resistance of the tube to implosion.

U.S. Pat. No. 3,166,211—Stel et al discloses an implosion protection system for a CRT comprising a fiber-impregnated sheath on the exterior of the CRT bulb. In one embodiment, glass fibers are embedded in a cord which is wrapped around and bound to the exterior of a tube to provide implosion protection.

Yet another implosion protection system for a conventional CRT bulb is disclosed in U.S. Pat. No. 3,220,593 in which a webbing material is glued to a substantial portion of the funnel and to the faceplate flange. A tension band is applied around the flange of the faceplate and over the webbing material. Systems such at this have apparently not met the rigid test of commercial use; to my knowledge, no such system has found a practical application in the color television picture tube market. Other U.S. Pat. Nos. disclosing the use of a webbing material in an implosion protection system for a color CRT are 3,206,056 and 3,314,566.

This invention has exclusive application to a non-conventional color CRT bulb having a flangeless faceplate, as shown, e.g., in U.S. Pat. No. 3,912,963. The referent U.S. Pat. Nos. 4,037,255, 4,004,092, 4,016,364, 4,021,850, and 4,012,773, and copending application Ser. No. 718,631 discloses a number of predecessor implosion protection systems for a bulb of such character.

A U.S. Pat. No. 2,222,197 to Engels discloses a CRT in which the bulb comprises a flangeless faceplate inset in an expanded open end of a cooperating funnel. A band allegedly providing implosion protection surrounds the outside of the funnel near the open end thereof.

OBJECTS OF THE INVENTION

It is an object of the present invention to provide a highly effective implosion protection system for a color television picture tube having a flangeless faceplate.

BRIEF DESCRIPTION OF THE DRAWINGS

The features of the invention which are believed to be novel are set forth with particularity in the appended claims. The invention, together with further objects and advantages thereof, may be best understood, however, by reference to the following description taken in conjunction with the accompanying drawings, and in which:

DESCRIPTION OF THE PREFERRED EMBODIMENTS

This invention is directed to the provision of an improved implosion protection system for a particular kind of nonconventional color CRT bulb having a flangeless faceplate and a funnel with a convex seal land which mates with the concave inner surface of the faceplate.

Figures 1, 2:
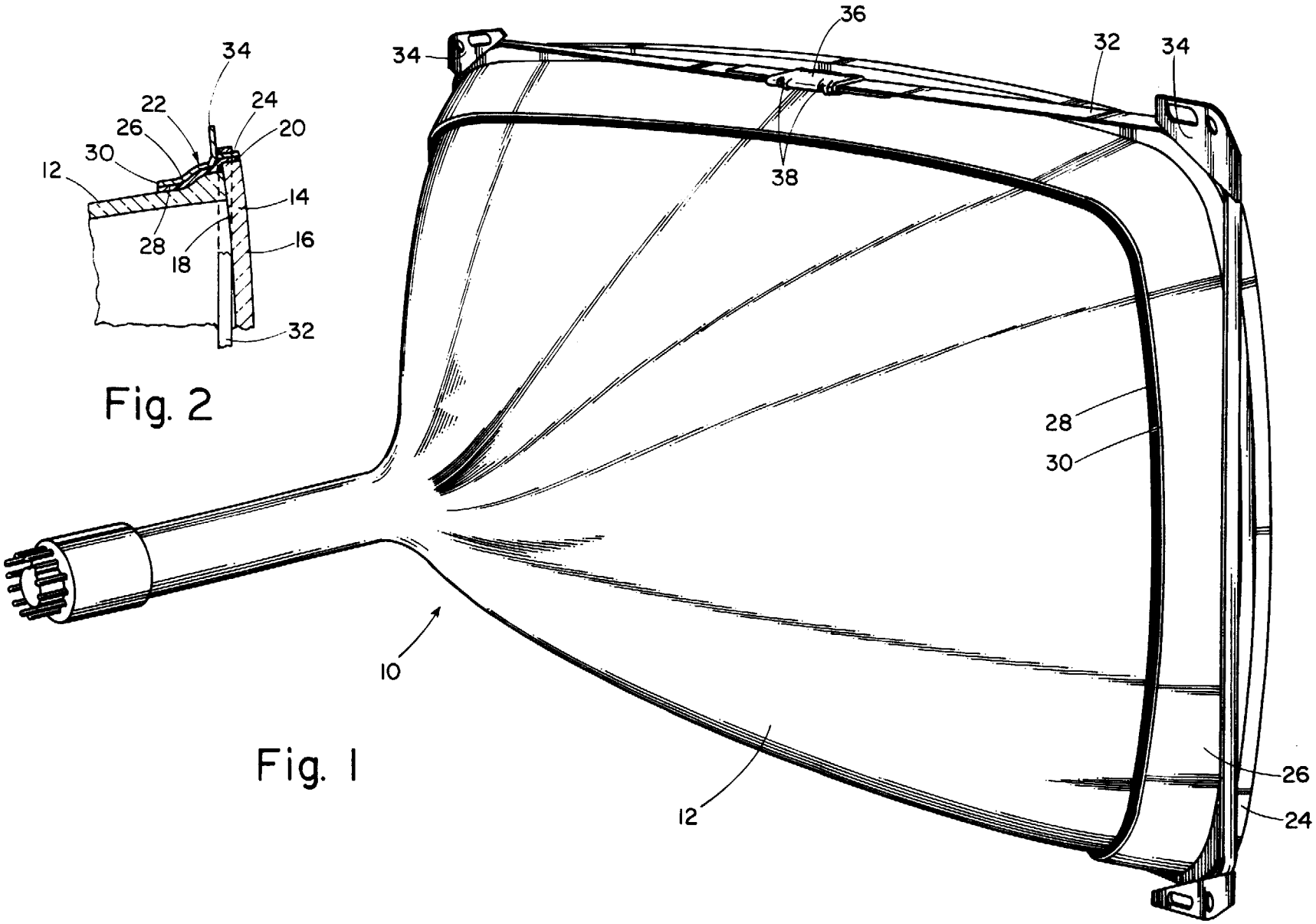
FIG. 1 is a schematic rear perspective view of a color cathode ray tube embodying the present invention.
FIG. 2 is a section view taken along lines 2—2 in FIG. 2.

Briefly, the tube with which this invention may be advantageously associated is illustrated schematically at 10 in FIGS. 1-2. The tube 10 has an envelope or bulb comprising a funnel 12 sealed to a flangeless faceplate 14. The faceplate 14 has a three-dimensionally curved configuration which may be spherical, multi-radial, cylindrical, or of other suitable curvature. The faceplate 14 has a convex front surface 16, a concave rear surface 18, and an edge surface 20 between the front and rear surface 16 and 18 of the faceplate 14. The edge surface 20 of the faceplate 14 arches away from a reference plane connecting the four corners of the faceplate along the sides of the faceplate.

The funnel 12 has a convex seal land, herein intended to mean a seal land which lies on an imaginary curved surface, which surface curvature may be spherical, multi-radial, cylindrical, or other suitable configuration corresponding to that of the concave rear surface 18 of the faceplate 14. The seal land of the funnel 12 is hermetically bonded to the rear surface 18 of the faceplate 14 by a devitrifying glass cement, commonly termed a "frit" material.

The faceplate 14 is illustrated as being slightly larger than the mouth of the funnel 12, resulting in a slight overhang of the faceplate over the funnel. Alternatively, the faceplate edge surface 20 may be flush with the outside surface of the mouth of the funnel 12.

An implosion protection system according to the present invention for protecting a bulb of the character outlined will now be described. Briefly, in accordance with the teachings of this invention, a highly effective hybrid implosion protection system is provided which includes a high tensile strength frame which surrounds and closely hugs at least the edge surface 20 of the faceplate. In a cavity between the frame and the edge surface of the faceplate is formed a hardened cement, the frame and cement binding up the edge surface of the faceplate to provide a measure of implosion protection. A tension member is disposed over the frame and its hardened contents, surrounding the faceplate in straight lines between the faceplate corners. Means on the frame retain the member on the faceplate corners. The tension member produces radially inwardly directed force components on the faceplate corners through the frame and hardened cement. The combination of the cemented frame and tension member produce a high degree of implosion protection for the bulb.

In more detail, FIGS. 1-2 depict an embodiment of the invention wherein the frame is shown at 22 and includes a front portion 24 surrounding the edge surface 20 of the faceplate. In the illustrated embodiment a rear portion 26 of the frame 22 surrounds and is cemented to the marginal portion of the funnel which defines the convex seal land thereon. A cement 28 disposed in a cavity provided between the frame 22 and the bulb bonds the frame 22 to the bulb. It is noted that the concepts of implosion protection structures comprising a high tensile strength frame bonded to a forward marginal portion of a funnel and/or the edge surface of a flangeless faceplate is not, per se, an aspect of this invention, but rather constitutes inventions described and claimed in the referent copending applications.

The frame 22 is composed of a high tensile strength material such as steel. By contouring the frame 22 to the bulb, the amount of cement 28 needed is reduced. The cement 28 is preferably an epoxy resin — a cement which is not only extremely effective as a bonding agent, but is electrically insulative. The use of an electrically insulative cement obviates the customary wrapping of the sealing interface between the funnel and faceplate with an insulative tape to electrically insulate the sealing interface.

As shown, the rear portion 26 of the frame 22, is preferably scalloped and has its rear edge 30 lying in a plane. This permits the use of a low viscosity epoxy which may be poured in from the rear of the tube after the cavity between the frame 22 and the bulb is sealed (at the front of the tube).

In accordance with this invention, after the cement 28 has been permitted to harden, a tension member is placed over the frame 22 so as to surround the faceplate in straight lines between the faceplate corners. In order to retain the tension member 32 on the corners of the faceplate, the frame 22 is provided with four brackets 34, one at each corner of the frame. The brackets serve the important additional function of providing means for mounting the tube in a television receiver.

The tension member is illustrated as taking the form of a steel tension band 32. The tension band 32 may be composed of high tensile strength steel, having, for example, a width of about ¾ inch and a thickness of about 30 mils. The Young's modulus of the steel may be for example about ($30 \times 10^6$lbs. per sq. in.) and a breaking strength of about 125,000 psi. A tension band as described is quite rigid and will tend to elongate very little under the impact of a high energy fracture impulse.

The tension band is placed over the frame 22 and in front of the brackets 34. The band 32 may be tensed by means of any suitable tensioner such as the commercially available N-134 TV tensioner made by Signode Corporation. The tension in the band 32 is preferably in the range of about 1800 to 2600 pounds.

In order to retain the tension in the band, as seal 36 of the heavy duty type may be employed. A number of notches 38, here shown as being four in number, are made in the seal 36 and in the embraced ends of the tension band 32. The tension band, the seal, and the way in which the band is tensed and sealed are well known in the art. For more details on the structure and method of application of tension bands for implosion protection systems, reference may be had to U.S. Pat. No. 3,890,464. The tension in the tension band 32 produces radially inwardly directed force components on the faceplate corners through the frame and hardened cement 28. It is important that the current be permitted to set before the tension band is applied. If this step were not taken, the tension band would collapse the frame-to-bulb cavity, thereby deleteriously distorting the frame and the cement distribution and thus impairing the implosion protection afforded by the system.

The combination of a filled frame plus a tension band in accordance with this invention may permit the use of a shallower frame and less of the costly cement than otherwise necessary. The preferred cement utilized is type A epoxy.

According to this invention, to assemble an implosion system of the character shown in FIGS. 1 and 2, the frame 22 is placed over the bulb from the rear such that the front portion 24 of the frame 22 lies in close-hugging relationship to the edge surface 20 of the faceplate 14, and the rear portion 26 of the frame 22 lies closely adjacent the marginal front portion of the funnel. The gap or cavity between the frame and the bulb is then sealed at the front surface of the faceplate and the gap is filled from the rear with epoxy cement.

After the cement has hardened, the tension member, here shown as tension band 32, is placed over the frame so as to surround the faceplate in straight lines between the faceplate corners. The ends of the band are then overlapped and the band is tensed to an appropriate value, for example 1800–2600 pounds. The band is then sealed to preserve the said tension value in the band.

An implosion protection system such as illustrated in FIGS. 1–2 has been constructed and successfully tested. The frame was composed of cold-rolled steel, 0.025–0.030 inch thick, with a skirt depth (front to back) at the corners of the faceplate of about ¼ inches. The gap between the frame 22 and the edge surface 20 of the faceplate 14 was in the range of about 0.090 inch to 0.100 inch. A liquid type A epoxy cement was introduced into the gap so as to cover the edge surface, the sealing interface, and the marginal front portion of the funnel 12. A tension band having a maximum strength of 125,000 psi was drawn to a tension of 1800–2600 pounds.

Figures 3, 4:
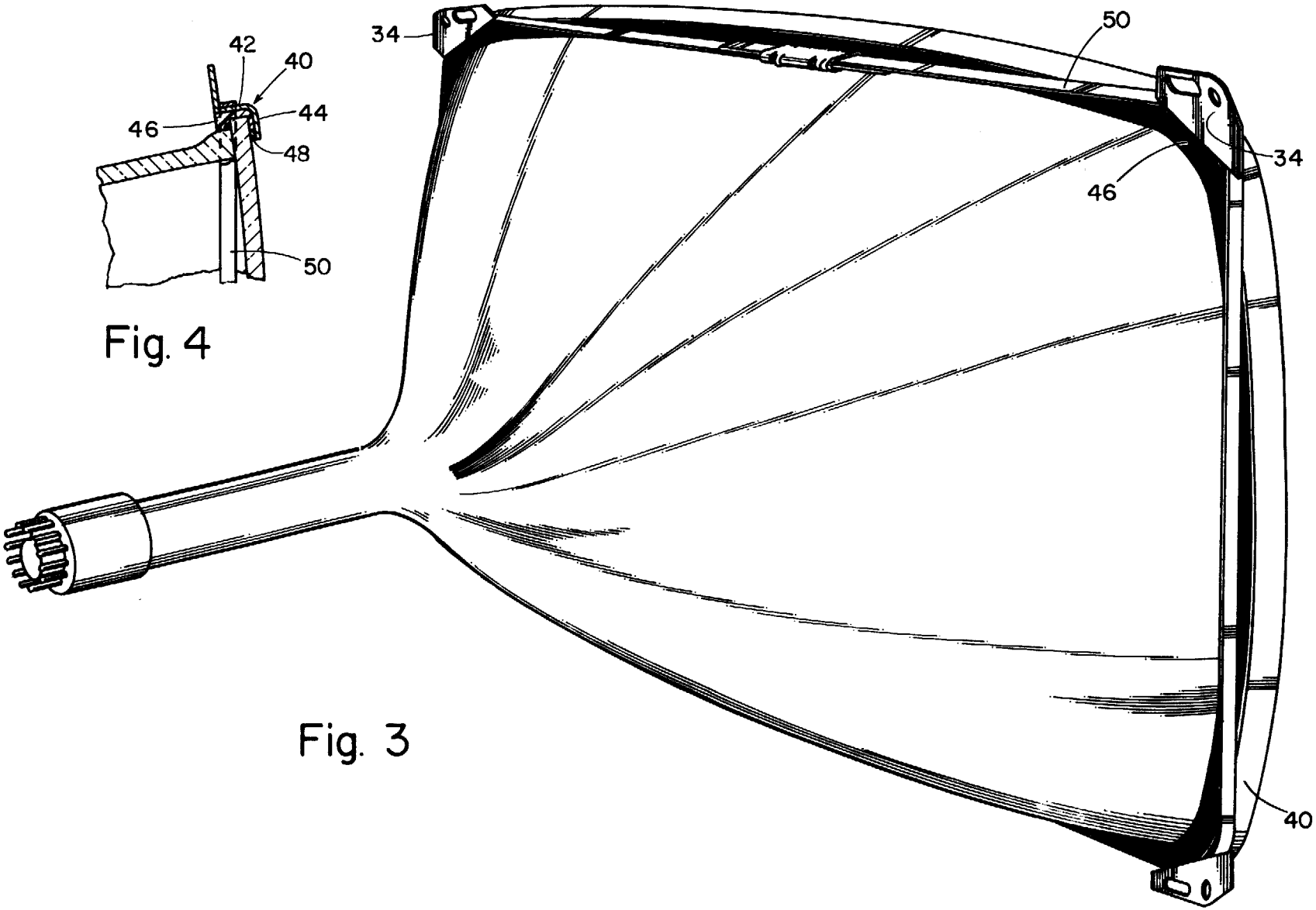
FIG. 3 is a schematic rear perspective view of a color cathode ray tube which includes an alternative embodiment of one aspect of the present invention.
FIG. 4 is a section view taken along lines 4—4 in FIG. 3.

FIGS. 3–4 illustrate another embodiment of the invention which is similar to the FIGS. 1–2 embodiment except that a shallow, constant height frame which binds up primarily the edge surface 20 of the faceplate is employed. A cemented frame which binds up the edge surface of a flangeless faceplate to provide implosion protection is, per se, the subject of the referent U.S. Pat. No. 4,016,364

In the FIGS. 3–4 embodiment, the frame 40 has a side flange 42 which surrounds the edge surface 20 of the faceplate, and a front lip 44 which overlies a marginal area of the front surface 16 of the faceplate. A cement 46 is employed to bond the frame 40 to the faceplate. A gasket 48 is employed to seal the radially inwardly disposed opening of the gap between the frame and bulb to permit application of cement from the rear of the bulb.

Because the frame 40 does not have a planar rear edge and thus cannot be filled with a low viscosity epoxy, in the FIGS. 3–4 embodiment an epoxy of the thixotropic type B such as Hysol M298 is preferably employed. This type of epoxy cement is more viscous and may be applied in a system as shown in FIGS. 3–4 without running out of the frame before it can be cured.

The frame has a plurality of brackets 34 which retain a tension member, here again shown in the form of a tension band 50, which may be described above with respect to the FIGS. 1–2 embodiment. Again, it is important that the cement be permitted to cure before the tension band 50 is applied.

The FIGS. 3–4 embodiment has the advantage compared to the FIGS. 1–2 embodiment of having a lighter, less expensive frame, and requiring substantially less cement to bond the frame to the bulb.

The invention is not limited to the particular details of construction of the device depicted and other modifications and applications are contemplated. For example, the frame may be of a character shown and described in the referent copending U.S. Pat. No. 4,012,773 wherein the frame includes a flange overlying and bonded to a relatively wide marginal area of the convex front surface 16 of the faceplate. Alternatively, a deep or shallow scalloped and cement-filled frame may be employed. Still other configurations of frames may be employed. Rather than using a tension band as shown at 32 in the FIGS. 1–2 embodiment, and 50 in FIGS. 3–4, other tension members such as cables may be employed. It is intended therefore that the subject matter in the above depiction shall be interpreted as illustrative and not in a limiting sense.

What is claimed is:

1. A color television picture tube having a glass bulb including an approximately rectangular, flangeless, three-dimensionally curved faceplate having a convex front surface, a concave rear surface and an edge surface which, along the sides of the faceplate, arches away from a reference plane connecting the four corners of the faceplate, the glass bulb also having a funnel with a convex seal land which mates with the concave inner surface of the faceplate, said tube having a hybrid implosion protection system comprising:

a high tensile strength frame which surrounds and closely hugs at least said edge surface of said faceplate to define a cavity between said frame and said edge surface;

a hardened cement in said cavity between said frame and said faceplate, said frame and said cement binding up said edge surface of said faceplate to provide a measure of implosion protection; and a tension member disposed over said frame and the hardened cement in said cavity so as to surround said faceplate in straight lines between the faceplate corners, and means on said frame for retaining said tension member on the faceplate corners, said member being under tension to produce radially inwardly directed force components acting on the faceplate corners through said frame and the hardened cement, the combination of said cemented frame and tension member producing a high degree of implosion protection for the bulb.

2. The apparatus defined by claim 1 wherein said frame also includes an integral portion which surrounds and is cemented to a marginal portion of said funnel defining said convex seal land.

3. A color television picture tube having a glass bulb including an approximately rectangular, flangeless, three-dimensionally curved faceplate having a convex front surface, a concave rear surface and an edge surface which, along the sides of the faceplate, arches away from a reference plane connecting the four corners of the facelate, the glass bulb also having a funnel with a convex seal land which mates with the concave inner surface of the faceplate, said tube having a hybrid implosion protection system comprising:

a high tensile strength frame which surrounds and is closely spaced from and a marginal portion of said funnel adjacent said faceplate to define a cavity between the frame and the bulb, said frame having a radially outwardly extending bracket at each corner thereof;

a hardened cement in said cavity between said frame and said faceplate, said frame and said cement binding up said edge surface of said faceplate, said marginal portion of said funnel, and the faceplate-funnel interface to provide a measure of implosion protection; and a tension band disposed over said frame and the hardened cement in said cavity so as to surround said faceplate in straight lines between the faceplate corners, said tension member being retained on the faceplate corners by said brackets, said band being under tension to produce radially inwardly directed force components acting on the faceplate corners through the frame and hardened cement, the combination of said cemented frame and tension member producing a high degree of implosion protection for the bulb.

4. For use in the manufacture of a color television picutre tube having a glass bulb including an approximately rectangular, flangeless, three-dimensionally curved faceplate having a convex front surface, a concave rear surface and an edge surface which, along the sides of the faceplate, arches away from a reference plate connecting the four corners of the faceplate, the glass bulb also having a funnel with a convex seal land which mates with the concave inner surface of the faceplate, a method of assembling on the tube a hybrid implosion protection system comprising:

surrounding in close adjacency at least the edge surface of said faceplate with a high tensile strength frame so as to define a cavity between the frame and the faceplate edge surface;

introducing a cement into the cavity between the frame and the faceplate;

effectuating a hardening of the cement such that the frame and the cement bind up the edge surface of the faceplate to provide a measure of implosion protection; and after said cement is hardened, placing a tension member over said frame so as to surround the faceplate in straight lines between the faceplate corners, and then tensing the tension member to produce radially inwardly directed force components on the faceplate corners through the frame and hardened cement, the combination of the cemented frame and tension member producing a high degree of implosion protection for the bulb.

* * * * *